US007458746B1

(12) United States Patent
Zimmerman

(10) Patent No.: US 7,458,746 B1
(45) Date of Patent: Dec. 2, 2008

(54) MOBILE ASPHALT PRODUCTION MACHINE

(76) Inventor: Harold M. Zimmerman, 187 Wabash Rd., Ephrata, PA (US) 17522

( * ) Notice: Subject to any disclaimer, the term of this patent is extended or adjusted under 35 U.S.C. 154(b) by 446 days.

(21) Appl. No.: 11/207,960

(22) Filed: Aug. 22, 2005

(51) Int. Cl.
*E01C 19/12* (2006.01)

(52) U.S. Cl. ..... 404/101; 404/83; 404/108

(58) Field of Classification Search ..... 404/92, 404/95, 101, 108, 110, 83
See application file for complete search history.

(56) References Cited

U.S. PATENT DOCUMENTS

| | | | | | |
|---|---|---|---|---|---|
| 2,069,376 | A * | 2/1937 | Madsen | 404/92 |
| 2,169,406 | A * | 8/1939 | Cost et al. | 404/92 |
| 3,310,293 | A * | 3/1967 | Zimmerman | 366/6 |
| 3,820,914 | A * | 6/1974 | Zimmerman | 404/110 |
| 3,880,542 | A * | 4/1975 | Mullen | 404/101 |
| 3,967,913 | A * | 7/1976 | Gabriel, Jr. | 404/109 |
| 4,068,970 | A * | 1/1978 | Rowe | 404/120 |
| 4,072,435 | A * | 2/1978 | Coho et al. | 404/110 |
| 4,406,548 | A * | 9/1983 | Haws | 366/8 |
| 4,538,916 | A * | 9/1985 | Zimmerman | 366/40 |
| 4,781,466 | A * | 11/1988 | Zimmerman | 366/2 |
| 4,783,171 | A * | 11/1988 | Zimmerman | 366/37 |
| 5,251,999 | A * | 10/1993 | McCracken | 404/109 |
| 5,333,969 | A * | 8/1994 | Blaha et al. | 404/91 |
| 5,551,776 | A * | 9/1996 | Zimmerman | 366/68 |
| 5,590,976 | A * | 1/1997 | Kilheffer et al. | 404/72 |
| 5,615,973 | A * | 4/1997 | Campbell | 404/75 |
| 6,012,870 | A * | 1/2000 | Dillingham | 404/79 |
| 6,071,040 | A * | 6/2000 | Macku et al. | 404/108 |
| 6,220,782 | B1 * | 4/2001 | Yates | 404/75 |
| 6,988,849 | B1 * | 1/2006 | Zimmerman | 404/95 |
| 2003/0194273 | A1 * | 10/2003 | Lloyd | 404/83 |
| 2005/0175412 | A1 * | 8/2005 | Lloyd | 404/77 |
| 2006/0204333 | A1 * | 9/2006 | Musil | 404/95 |
| 2007/0122235 | A1 * | 5/2007 | Kasahara et al. | 404/75 |

* cited by examiner

*Primary Examiner*—Raymond W Addie
(74) *Attorney, Agent, or Firm*—Miller Law Group, PLLC

(57) ABSTRACT

A mobile asphalt production machine mixes bituminous concrete at the job site through a mixing auger mechanism mounted in an insulated housing. Propane burners provide heat within the mixing auger mechanism and within the insulated housing to produce a hot-mix bituminous concrete in large or small batches. The components of the asphalt mixture are stored in separate bins that can be re-filled at the job site to provide a continuous supply of asphalt. Hot liquid bitumen is added to heated aggregate within the mixing auger mechanism. Recycled asphalt can be added through a port in the mixing auger for incorporation into the mixture. Controls permit the rate of flow of each individual component to be selectively varied in order to change the recipe for the mixture and to provide calibration of the component, while a master control will maintain the pre-established flow rates through a variable speed of operation.

20 Claims, 8 Drawing Sheets

MOBILE ASPHALT PRODUCTION MACHINE

BACKGROUND OF THE INVENTION

The present invention is directed to machines that pave roads and, more particularly, to a self-contained mobile vehicle that is operable to create hot-mix bituminous concrete, asphalt, at the job site.

Roadways are typically formed with either a Portland cement concrete roadway or a roadway formed from bituminous concrete, which is often referred as asphalt. When the roadway surfaces deteriorate, the repair thereto is typically done with an asphalt patch, even the Portland cement concrete road surfaces. Very often, small repairs are done with cold-mix asphalt, which does not have a long life span and deteriorates quickly. Large repairs, even complete re-surfacing of the roadway, are accomplished with large paving machines that receive supplies of hot-mix asphalt from a central mixing plant. Large trucks carry the supply of hot-mix asphalt to the paving machines, which spread the asphalt into a wide swath having a uniform thickness and a smooth uniform surface.

The central asphalt mixing plant is a fixed asset that cannot be easily moved from one location to another. The distance from the job site to the central mixing plant, as well as the ambient temperature, will define the temperature of the hot-mix asphalt at the time of delivery to the job site. Once hot-mix asphalt is cooled, the material hardens and cannot be spread easily or compacted at the job site. The shortness of time during which the bituminous concrete material remains pliable makes the material difficult to be utilized for small repair jobs, or for jobs that are a substantial distance from the central mixing plant. Such problems are particularly difficult to overcome when the ambient temperatures are low, as will be found in the Northern states during the winter months.

In U.S. Pat. No. 3,820,914, granted to Harold M. Zimmerman on Jun. 28, 1974, a self-contained mobile asphalt mixing and applying apparatus was disclosed. This machine depicted in the '914 patent was expensive to manufacture and utilized a mixing drum that was rotated to mix and heat the aggregate for discharge into a mixing auger where the hot liquid bitumen was added to manufacture the bituminous concrete mixture. While this arrangement was successful in mixing small patches of hot-mix bituminous concrete, the volume required for large repairs and/or re-surfacing projects could not be produced. Furthermore, the machine disclosed in the '914 patent was not capable of recycling old bituminous concrete material.

Accordingly, it would be desirable to provide an improved mobile asphalt missing machine that could provide substantial volume of bituminous concrete at job sites.

SUMMARY OF THE INVENTION

It is an object of this invention to provide a mobile asphalt production machine that is capable of producing large quantities of bituminous concrete at a job site.

It is another object of this invention to provide a mobile asphalt production machine that carries supplies of the component material needed to produce bituminous concrete to be mixed at the job site.

It is a feature of this invention that the bituminous concrete is produced at the job site and does not have to be transported from a central mixing plant to the job site.

It is an advantage of this invention that the bituminous concrete can be discharged and placed at the job site immediately after being mixed.

It is another advantage of this invention that the temperature loss of the hot-mix bituminous concrete mixture is minimized from the moment of production to the moment of utilization at the job site.

It is another feature of this invention that old bituminous concrete material can be recycled into the on-site production of the bituminous concrete mixture.

It is still another feature of this invention that a mixing auger mechanism is utilized to produce continuously a bituminous concrete mixture.

It is still another feature of this invention that the machine incorporates a hopper for accumulating a limited supply of bituminous concrete mixture before being discharged to the job site.

It is still another advantage of this invention that the production of bituminous concrete is continuous to meet the demand of a high volume project.

It is yet another feature of this invention that the mixing auger mechanism is mounted within an insulated housing that is heated independently of the mixing auger mechanism to maintain temperature control of the asphalt mixture.

It is still another feature of this invention that the gaseous discharge from the mixing auger mechanism and from the heated housing is passed through a bag housing to control emissions.

It is yet another feature of this invention that the component supplies can be replenished at the job site to provide continuous long-term production of bituminous concrete at a job site.

It is a further feature of this invention to provide a control mechanism that allows for individual adjustment of the component materials for flow into the mixing auger mechanism to permit the mixture to be varied as desired.

It is yet another advantage of this invention that the individually adjustable flow controls can be pre-set for operation through a master control device.

It is still a further feature of this invention that the individual operative components of the mobile asphalt production machine can be calibrated for on-site production certification as needed.

It is a further advantage of this invention that different mix recipes can be accommodated with the individually adjustable flow controls for the operative components providing sand, stone, liquid bitumen (AC), and optional additives into the mixing auger.

It is still a further feature of this invention that the mixing auger mechanism utilizes a ribbon conveyor.

It is yet another object of this invention to provide a mobile asphalt production machine that can produce small batch of bituminous concrete at a job site for use in the repair of potholes on an existing roadway surface.

It is another feature of this invention that the mobile asphalt production machine can be equipped with a dispensing auger and chute for filling potholes with bituminous concrete manufactured at the job site.

It is another advantage of this invention that the cost of pothole repairs can be reduced by the manufacture of bituminous concrete at the job site, rather than producing the bituminous concrete at a remote location and transporting to the job site.

It is still another feature of this invention that a waste material receptacle is provided for disposal of debris accumulated in the pothole to be cleaned-out before being repaired.

It is a further object of this invention to provide a mobile asphalt production machine that is durable in construction, inexpensive of manufacture, carefree of maintenance, facile in assemblage, and simple and effective in use.

These and other objects, features and advantages are accomplished according to the instant invention by providing a mobile asphalt production machine that mixes bituminous concrete at the job site through a mixing auger mechanism mounted in an insulated housing. Propane burners provide heat within the mixing auger and within the insulated housing to produce a hot-mix bituminous concrete in large or small batches. The components of the asphalt mixture are stored in separate bins that can be re-filled at the job site to provide a continuous supply of asphalt. Hot liquid bitumen is added to heated aggregate within the mixing auger mechanism. Recycled asphalt can be added through a port in the mixing auger for incorporation into the mixture. Controls permit the rate of flow of each individual component to be selectively varied in order to change the recipe for the mixture and to provide calibration of the component, while a master control will maintain the pre-established flow rates through a variable speed of operation.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Referring to the FIGS. 1-7, a mobile asphalt production machine incorporating the principles of the instant invention can best be seen. The asphalt production machine 10 is mounted on a truck chassis 5, shown in phantom in FIG. 1, to provide mobility for the machine 10. The truck chassis 5 is preferably a tri-axle configuration, due to the weight of the machine 10 and of the aggregate and other components stored in the machine 10, as will be described in greater detail below. The truck chassis 5 includes a conventional engine and drive transmission (not shown) for affecting mobility of the machine 10. The arrangement is somewhat similar to the mobile concrete mixers of the type seen in U.S. Pat. No. 4,538,916, issued to Harold M. Zimmerman, on Sep. 3, 1985, which carry discrete quantities of the various materials and components used to produce Portland cement concrete. Such concrete mixing units have been marketed under the trademark ZIM-MIXER by Zimmerman Industries, Inc. of Ephrata, Pa.

Figure 4:
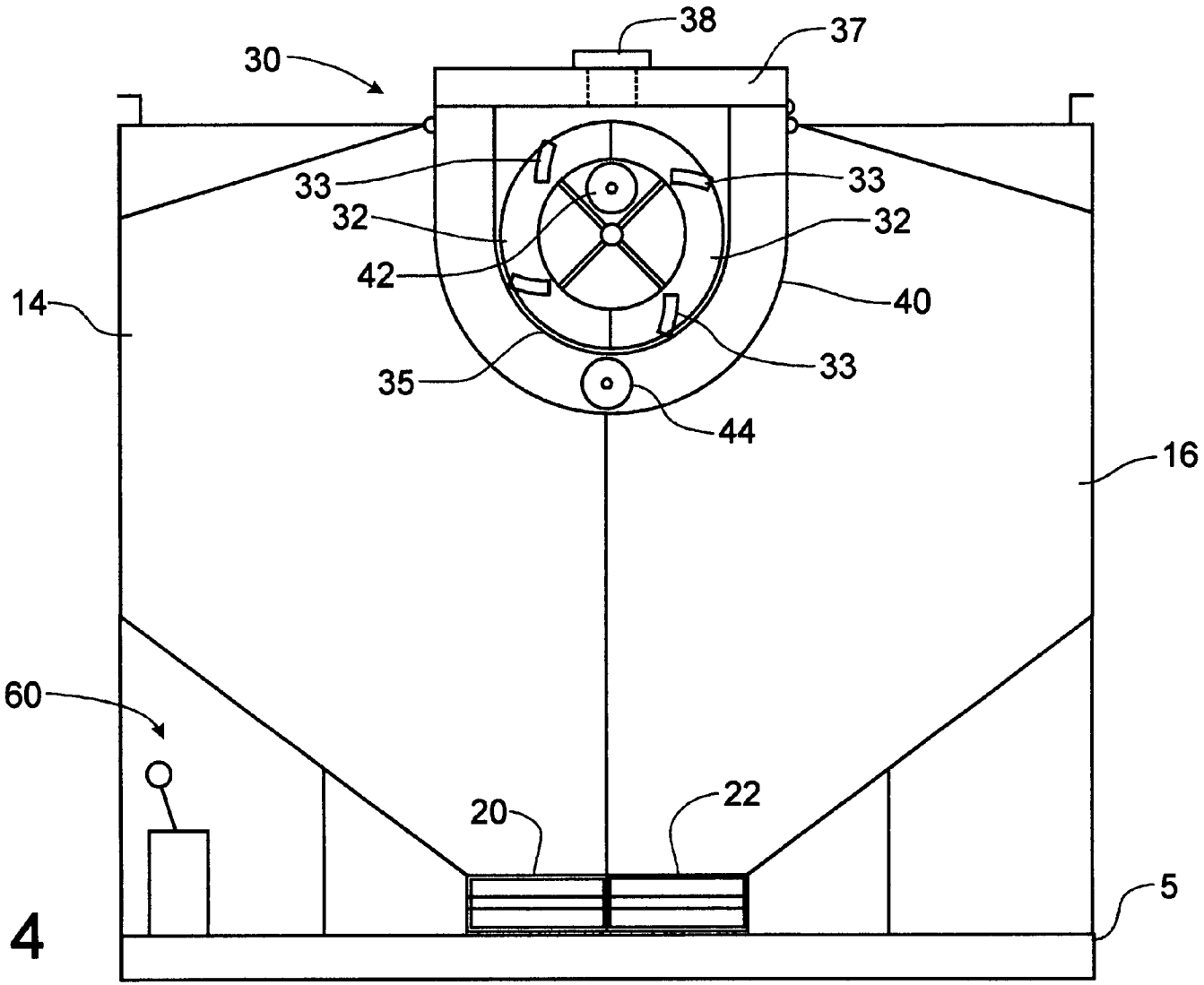
FIG. 4 is an enlarged cross-section view corresponding to FIG. 2, but depicting the lateral aggregate storage bins.
Figure 5:
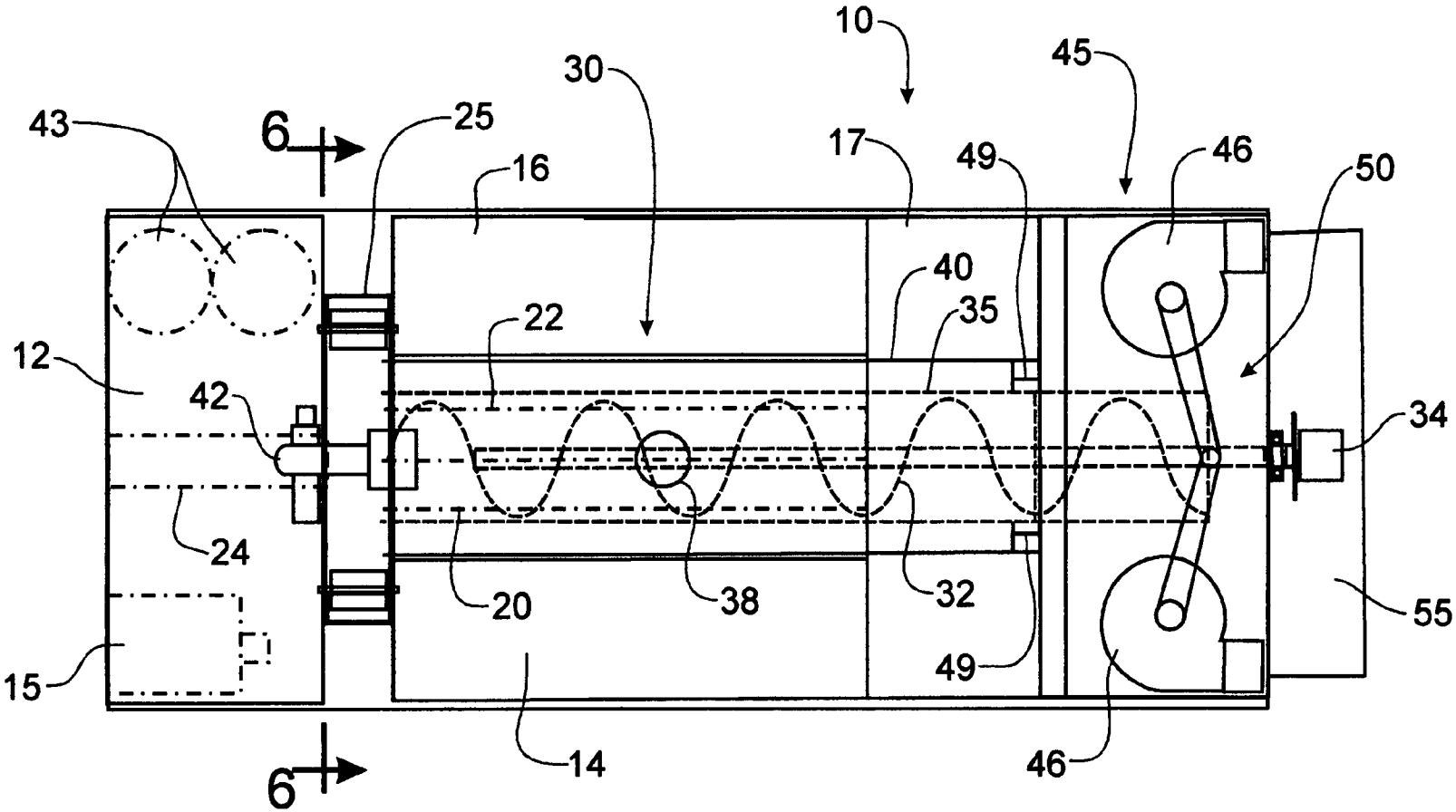
FIG. 5 is a top plan view of the mobile asphalt production machine depicted in FIG. 1.
Figure 6:
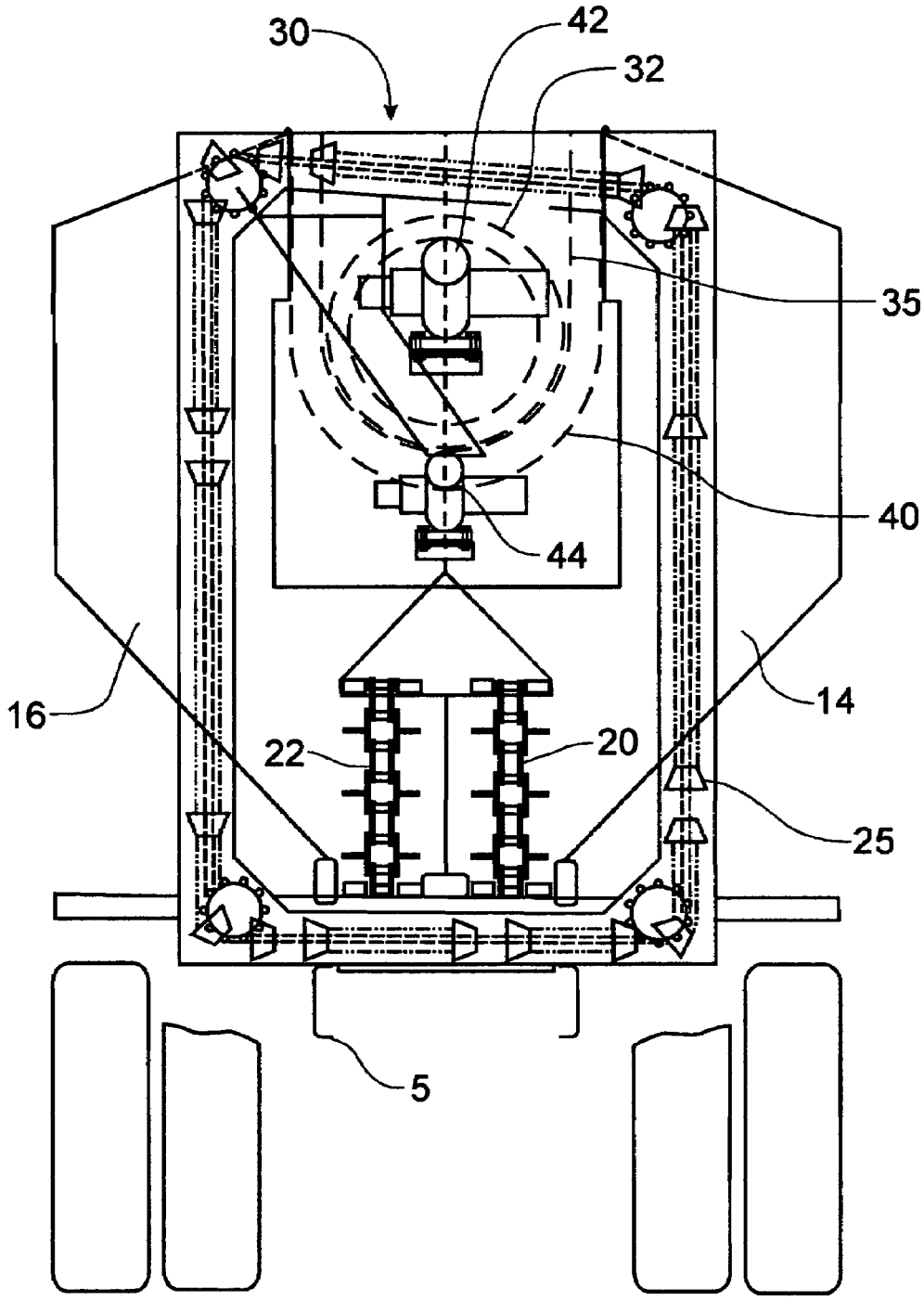
FIG. 6 is a front elevational view of the mobile asphalt production machine taken along lines 6-6 of FIG. 5.

The mobile asphalt production machine 10 is provided with at least four storage bins or tanks 12, 14, 16, 17 that are enclosed structures with an access opening that permits a re-filling thereof on the job site. Storage bin 12 is located at the forward end of the machine 10 and can be used to provide an optional supply of fine material, additives, or other materials desired for the production of the asphalt mixture to be created. The lateral aggregate storage bins 14, 16 are located behind the first storage bin 12 and are best seen in FIGS. 4-6. These laterally disposed storage bins 14, 16 stored large supplies of aggregate and sand for use in the production of the asphalt mixture. The fourth storage bin 17 is located behind the lateral bins 14, 16 and is used to contain a supply of liquid bitumen. A burner or heater (not shown) is used to keep the bitumen at a desired temperature to maintain liquidity in the bitumen.

The lateral storage bins 14, 16 are sloped, as is seen in FIGS. 4 and 6, to direct the material within the bins 14, 16 toward a chain and slat conveyor 20, 22 located at the bottommost portion of the bins 14, 16. The conveyors 20, 22 are preferably driven by hydraulic motors (not shown) and are independently adjustable as to speed of operation to permit the flow rate of aggregate and sand to be adjusted as desired according to the mixture to be created. The conveyors 20, 22 pull materials from the lateral storage bins 14, 16 to direct material into a bucket elevator 25 located between the first storage bin 12 and the lateral storage bins 14, 16. Similarly, the first storage bin 12 can have a chain and slat conveyor 24 to deliver material therefrom rearwardly into the bucket elevator 25. The conveyors 20, 22 can be constructed to have a return run that passes through the respective storage bins 14, 16, as is depicted in FIG. 6. The details of the chain and slat conveyors 20, 22 are described in aforementioned U.S. Pat. No. 4,538,916, the contents of which are incorporated herein by reference. The last storage bin 17 has a discharge pipe 19 through which the liquid bitumen is pumped into the mixing auger mechanism 30, as is described in greater detail below.

The mixing auger mechanism 30, as can be seen in FIGS. 1-4, is mounted at the top of the machine 10 above and between the lateral storage bins 14, 16. As opposed to the mixing drum disclosed in the '916 patent, the mixing auger mechanism 30, as described herein, can be oriented substantially horizontally. The mixing auger mechanism 30 includes a longitudinally extending ribbon auger 32 that cooperates with a semi-circular auger tube 35 against which the ribbon auger 32 works. The ribbon auger 32 is also provided with fins or paddles 33 mounted on the periphery of the ribbon auger 32. The fins or paddles 33 operate to throw aggregate and other material within the auger tube 35 upwardly to enhance mixture thereof within the mixing auger mechanism 30. The top part of the auger tube 35 is preferably closed by an insulated lid 37 that is hinged to open the auger tube 35 for inspection, servicing and clean-out, as needed. The auger tube 35 is set within a similarly shaped housing 40 that is insulated and spaced outwardly from the auger tube 35 to provide an annular space therebetween. The annular space and the insulation provided by the housing 40 helps to keep the heat, as will be described in greater detail below, within the auger tube 35.

A pair of burners 42, 44 is mounted at the forward end of the mixing auger mechanism 30 to provide a source of heat for the mixture of hot-mix bituminous concrete within the mixing auger mechanism 30. The burners 42, 44 can be fired from oil or, preferably, by propane. The burners 42, 44 are fueled from storage tanks 43 for the propane and supply a substantial amount of heat energy into the mixing auger mechanism 30. The first burner 42 is positioned to fire into the auger tube 35 to provide a direct heat source into the mixing auger mechanism 30, while the second burner 44 is positioned to fire into the insulated housing 40 below the auger tube 35. The combustion gases from the burners 42, 44 can be trapped within the auger tube 35 and the housing 40, respectively, and discharged at the rear of the mixing auger mechanism 30 into a bag housing 45 to eliminate unwanted emissions into the environment. However, since the combustion gases from the burner 44 do not mix directly with the bituminous concrete mixture being produced, the combustion gases from the second burner 44 can be discharged through a flue 49 positioned in front of the bag housing 45 while the combustion gases from the first burner 42 are exhausted through the bag housing. Water for emergency use can be stored in a tank 15 positioned below the first storage tank 12 opposite the propane storage tanks 43.

The bag housing 45 can be positioned on either side or on both sides of the mixing auger mechanism 30 and can include one or more exhaust fans 46 that draw the combustion gases and airborne materials from the production of the hot-mix bituminous concrete mixture upwardly through a filter 47 before being discharged to the atmosphere. The filter 47 removes the contaminants in the combustion gases before being discharged. An access door (not shown) is provided at the rear of the machine 10 to permit access to the filter 47 for servicing and changing the filter as needed to maintain air quality controls.

The lid 37 of the mixing auger mechanism 30 is provided with an access port 38 that can be opened for the introduction of recycled bituminous concrete material. The access port 38 is located approximately mid-way along the auger tube 35 to give adequate opportunity for the recycled asphalt materials to become melted and incorporated into the mixture. The access port 38 is preferably closed during normal operation of the mixing auger mechanism 30, but can be opened and connected to a delivery mechanism (not shown) that would be operable to introduce into the mixing auger mechanism 30 pieces of bituminous concrete that is being recycled into the new mixture.

The liquid bitumen is introduced into the mixing auger mechanism 30 at about the mid-point of mixing auger mechanism 30, downstream of the access port 37, via the discharge tube 19 delivering the heated liquid bitumen from the storage tank 17. The liquid bitumen is sprayed into the auger tube 35 for mixing with the heated aggregate being thrown about by the ribbon auger 32 and the outwardly projecting fins 33. The flow rate of the liquid bitumen is established through the control mechanism described in greater detail below and is proportionate with the flow rates of the aggregate and other materials delivered from the storage bins 12, 14, and 16 to create the desired asphalt mixture.

Figure 1:
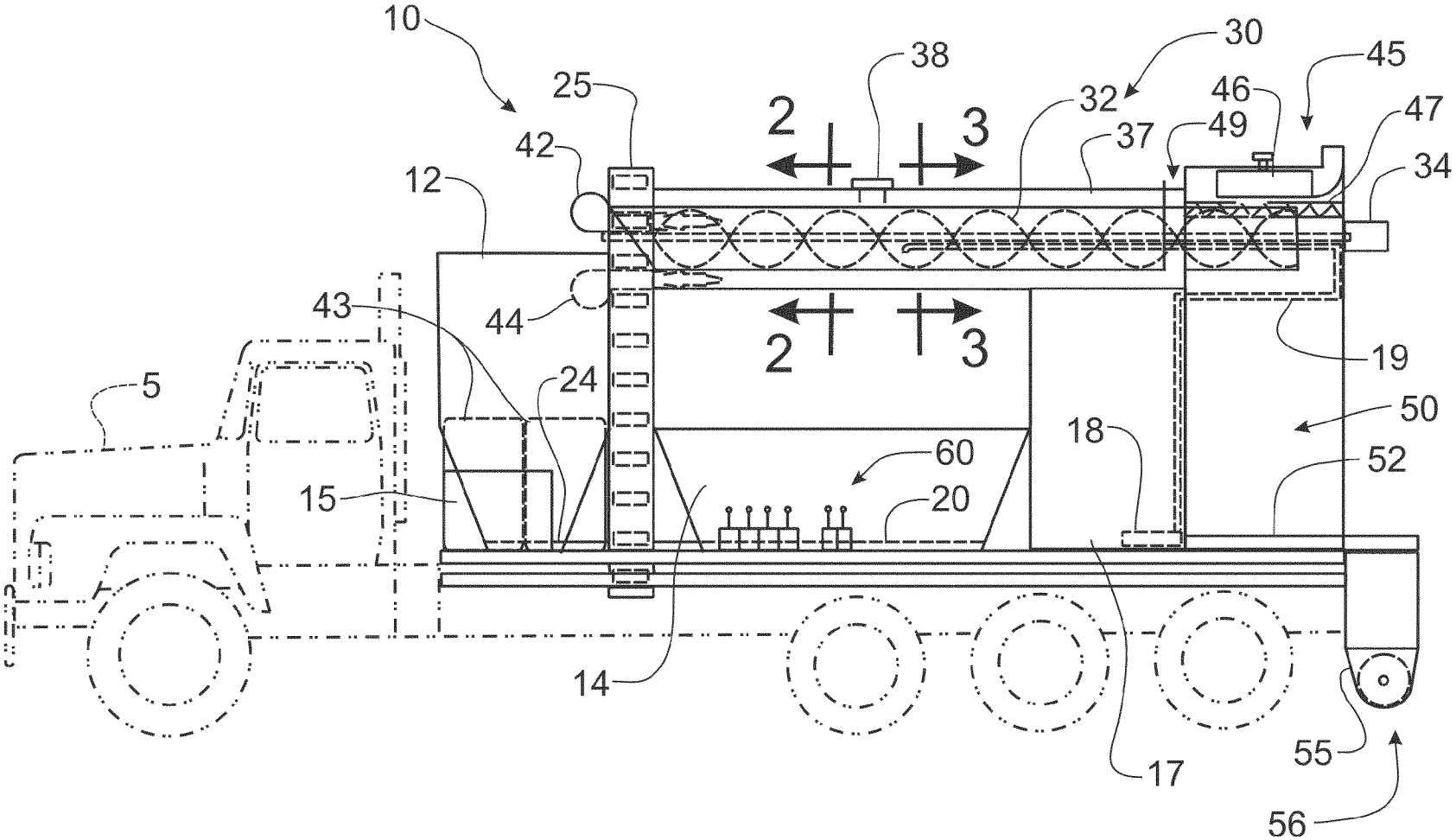
FIG. 1 is a schematic side elevational view of a mobile asphalt production machine incorporating the principles of the instant invention, the main frame and operator's cab of the truck being shown in phantom.
Figure 3:
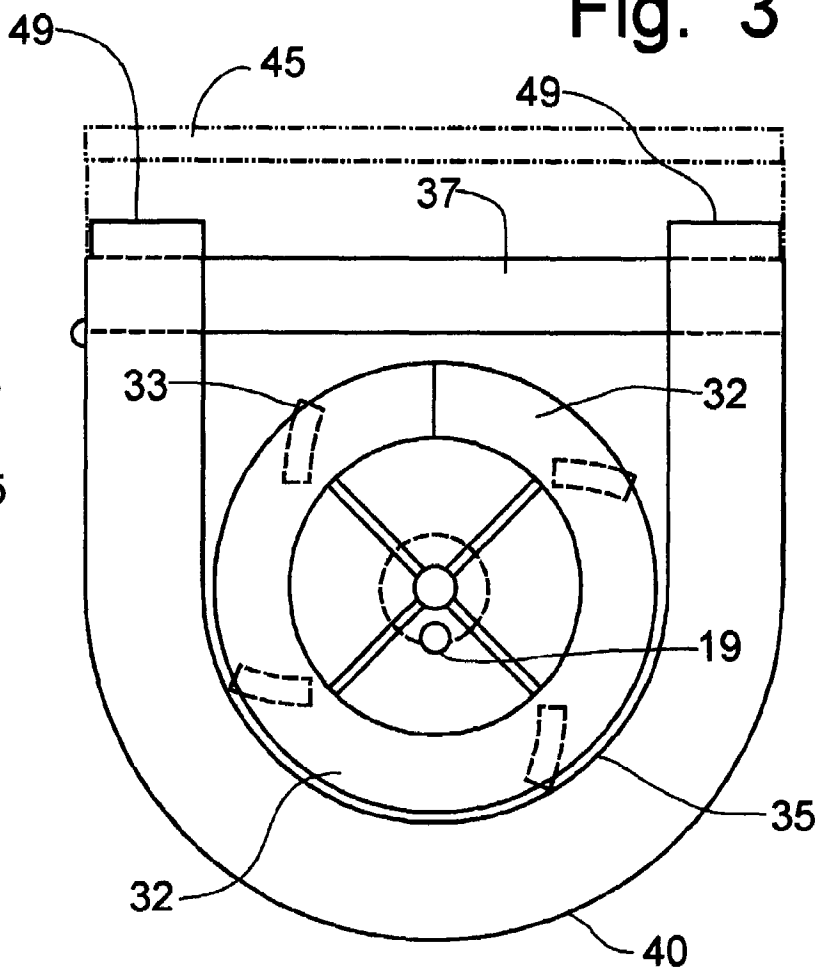
FIG. 3 is a cross-section view through the mixing auger mechanism taken along lines 3-3 of FIG. 1, to depict an elevational view of the mixing auger mechanism looking rearwardly toward the discharge end of the mixing auger mechanism.
Figure 2:
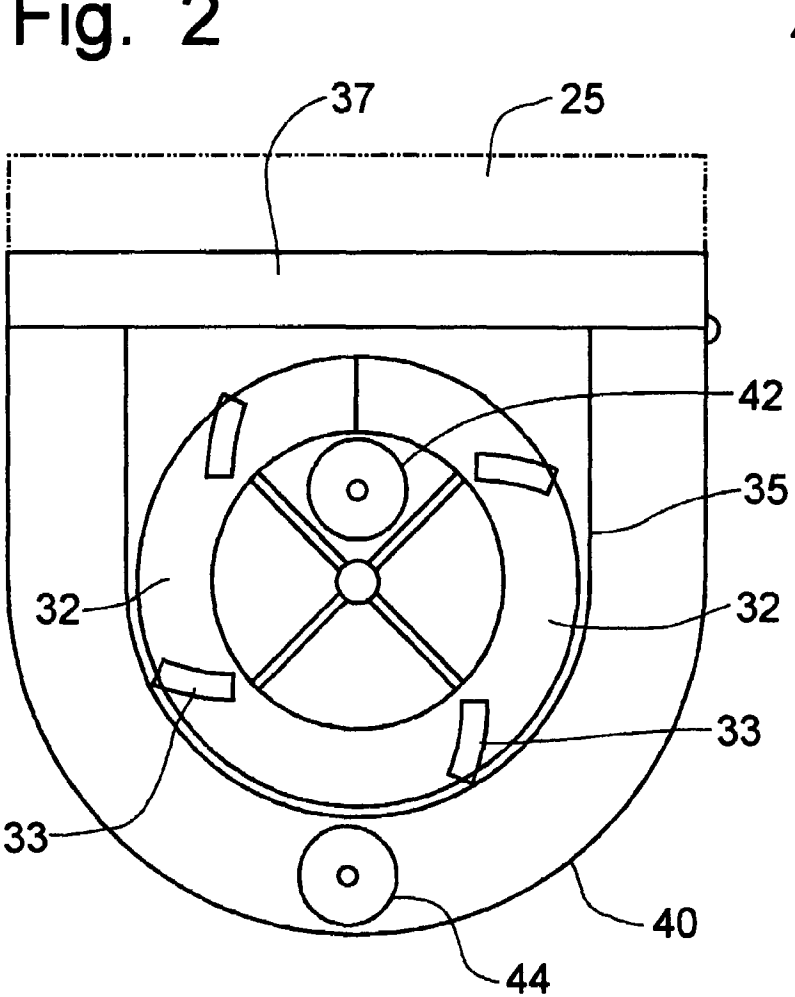
FIG. 2 is a cross-section view through the mixing auger mechanism taken along lines 2-2 of FIG. 1, to depict an elevational view of the mixing auger mechanism looking forwardly toward the burners.
Figure 8:
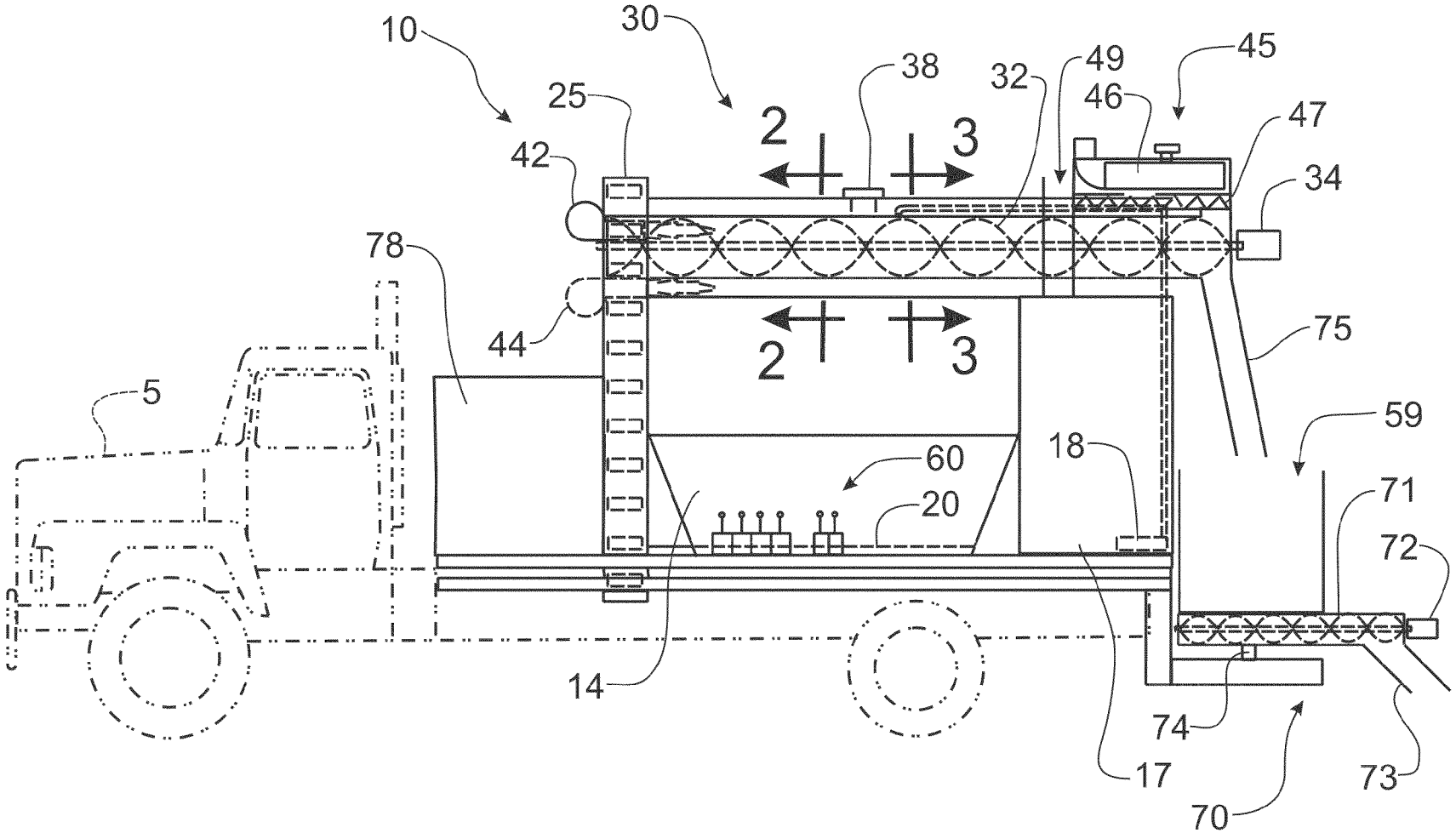
FIG. 8 is a side elevational view of a smaller version of the mobile asphalt production machine that is adapted for use in the repair of potholes in existing roadway surfaces, a representative dispensing auger being depicted at the rearward end of the machine to receive bituminous concrete material from the mixing auger.

The mixing auger mechanism 30 discharges the mixed asphalt mixture out of the rearward end of the auger tube 35 into an enclosed, insulated accumulation hopper 50 that is operable to receive a supply of asphalt mixture from the missing auger mechanism 30 and accumulate the asphalt mixture until a conveyor 52 is actuated to remove the asphalt mixture from the hopper 50 into a distribution mechanism 55. The distribution mechanism 55 can be in the form of a spreader 56, as is depicted in FIG. 1, or an elongated, pivoted dispensing conveyor apparatus 70, such as an auger conveyor 71 as depicted in FIG. 8, that would receive the asphalt mixture from the hopper conveyor 52 and direct the discharge thereof as needed within the reach of the auger conveyor (not shown). When operating at peak efficiency, the machine 10 would provide a continuous flow of mixed asphalt discharged from the rearward end of the auger tube 35 onto the hopper conveyor 52 for distribution externally of the machine 10.

Figure 7:
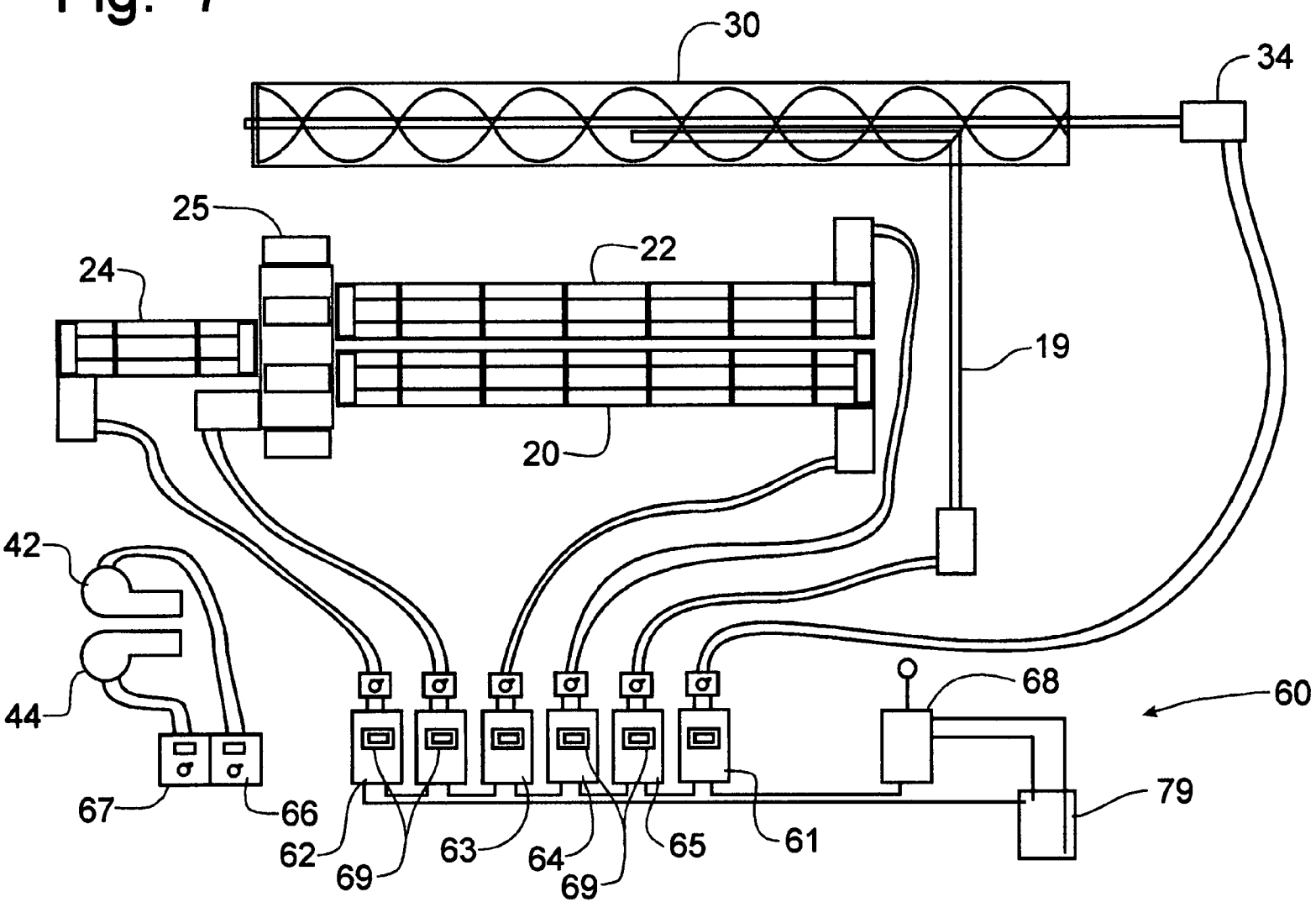
FIG. 7 is a schematic diagram of the control mechanism for the mobile asphalt production machine shown in FIG. 1.

All of the operative components of the asphalt production machine 10 are preferably driven hydraulically, such as through the hydraulic motor 34, and operatively controlled through the control mechanism 60. One skilled in the art will recognize that other operative power could be used for the components of the machine 10, but the use of hydraulic drives is convenient and easy to control selectively. The control mechanism 60 is best seen in FIG. 7 and includes a first valve 61 for operation of the hydraulic motor 34 for varying the speed of rotation of the ribbon auger 32. The speed of rotation of the ribbon auger 32 is directly related to the flow rate of the output from the mixing auger mechanism 30.

Similarly, the control mechanism 60 also includes a second valve 62 for controlling the speed of operation of the conveyor 24 for the front storage bin 12, a third valve 63 for controlling the speed of operation of the conveyor 20 in the lateral storage bin 14, a fourth valve 64 for controlling the speed of operation of the conveyor 22 in the other lateral storage bin 16, a fifth valve 65 for controlling the flow rate of the pump 18 for discharging the liquid bitumen through the discharge pipe 19 out of the storage tank 17 into the mixing auger mechanism 30, and possibly a sixth valve (not shown) for the control of the operative speed of the bucket elevator 25 delivering materials into the mixing auger mechanism 30. The two burners 42, 44 are controlled by controls 66, 67, including on/off function and flow rate of propane thereto.

One of the operative functions described above, such as the pump rate of the liquid bitumen could be maintained as a constant parameter, so that the rate of delivery of the conveyors 20, 22 and 24 could be varied selectively to change the ratio of the respective components for the asphalt mixture. Thus, the sixth control valve (not shown) is preferably optional.

A master control valve 68 overrides all of the other control valves 61-65 in that the master control valve controls the rate of flow of hydraulic fluid to the respective valves for operative control of the corresponding component. Thus, the control valves 61-65 set proportionate flows for controlling the operation of the corresponding operative component for delivery of the component for the asphalt mixture into the mixing auger mechanism 30. Accordingly, if the second control valve 62 were set to deliver a first flow rate of 10 and the second control valve 62 were set to deliver a second flow rate of 5, twice as much aggregate in the first lateral bin 14 would be delivered to the bucket elevator as the sand, or other aggregate, in the second lateral bin 16. The master control valve 68, however, dictates the overall speed at which the conveyors deliver material to the bucket elevator 25, even though twice as much aggregate from storage bin 14 will be delivered as compared to the material in storage bin 16, according to the example set forth herein.

As is seen in FIG. 7, the control mechanism 60 is a banded hydraulic system that delivers a flow of hydraulic fluid under pressure from a reservoir 79 to the master control valve 68 which is operable to divert a selected flow rate into the system, as described below, and return the remaining hydraulic fluid to the reservoir 79. The hydraulic fluid delivered into the system passes into a first control valve 61 which diverts a preselected flow rate to the hydraulic motor 34 driving the rotation of the mixing auger mechanism 30, passing the remaining hydraulic fluid on to the second control valve 62 along with the return hydraulic fluid from the hydraulic motor 34. Similarly, the second control valve 62 diverts the preselected flow rate to the hydraulic motor driving the operation of the conveyor 24, which can be set anywhere from a zero flow rate to a maximum flow rate. The remaining hydraulic fluid along with the return hydraulic fluid from the conveyor 24 is then received at the third control valve 63 which diverts hydraulic fluid at the preselected rate set for the operation of the conveyor 20, and then to the fourth control valve 64 which diverts fluid at the preselected flow rate to the conveyor 22, and so on through all the control valves until the final control valve in the series returns the hydraulic fluid to the reservoir 79.

Each operative component and the associated control valve 61-65 has a counter 69 associated with the operation of that particular component so that the counter records the number of revolutions of the corresponding hydraulic motor which is then calibrated to a corresponding quantity of material delivered by the operative component. For example, an reading of 10 on the counter for the conveyor 20 may indicate that 100 pounds of sand has been delivered into the mixing auger mechanism 30. Repeated calibrations of the counter readings to the volume of material delivered can be obtained by opening a test door (not shown) corresponding to the component being calibrated and weighing the amount of material delivered for a given counter reading. Various recipes for bituminous concrete can then simply be dialed into the control valves. If stone is being delivered by the conveyor 22 and, as an example, no stone is desired for the particular recipe being mixed, the setting on the control valve 64 for the conveyor 22 would be zero, thus no stone would be delivered to the elevator 25.

Accordingly, the throughput of the machine 10, i.e. the rate of production of the asphalt mixture discharged from the auger tube 35, can be set through the master control valve 68. Furthermore, the operation of the first valve 61 controlling the operative speed of the ribbon conveyor 32 can be tied directly to the master control valve 68, instead of being an independent control. The higher the desired output of the machine, the greater the amount of component materials that need to be delivered into the mixing auger mechanism 30, and the greater the rotational speed of the ribbon conveyor 32 is needed.

In operation, the asphalt production machine 10 mounted on the truck chassis 5 is driven to the selected job site, which can be either a small or large repair patch or a re-surfacing of the roadway surface. The mixture ratios of aggregate types to the flow rate of liquid bitumen is selected through the manipulation of the control valves 62-65 to provide a selected "recipe" for the asphalt mixture. Generally, the proportional valves 62-65 are pre-set and not normally changed, unless the "recipe" needs to be adjusted. The master control valve 68 is manipulated to start the operation of the various operative components of the machine 10 to deliver aggregate and sand from the storage bins 12, 14 and 16 into the bucket elevator 25. The bucket elevator 25 raises the combined aggregate materials to the forward end of the mixing auger mechanism 30 and discharges the aggregates into the beginning of the auger tube 35.

The burners 42, 44 have been ignited to pre-heat the mixing auger mechanism 30 and the housing 40 and operate to heat the aggregates being delivered into the front of the auger tube 35. The rotating ribbon conveyor 32 both transports the heated aggregates along the auger tube 35 and tosses the aggregates into the air to obtain a greater exposure of the individual aggregate components to the heated air. Re-cycled bituminous concrete materials can be introduced into the aggregate mixture through the access port 38. Liquid bitumen is then pumped from the storage tank 17 through the discharge pipe 19 into the central part of the mixing mechanism 30. The tossing action of the fins 33 on the ribbon conveyor flights 32 substantially enhances the mixing of the aggregate particles with the liquid bitumen to effectively coat the individual aggregate particles.

The mixed aggregates and liquid bitumen forms an asphalt mixture that is discharged from the rearward end of the auger tube 35 into the accumulation hopper 50. If the operator is ready to utilize the discharged asphalt mixture, the operator then actuates the discharge conveyor 52 in the bottom of the hopper 50 to discharge the accumulated asphalt mixture into the selected distribution device 55.

For a continuous large supply of bituminous concrete from the asphalt production machine 10 for utilization at the selected job site, the operator can have supplies of the component aggregates, sand, bitumen and propane delivered to a location adjacent the job site. A loader can then replenish the supplies of aggregate and other materials into the asphalt production machine 10 so that the production of bituminous concrete can continue without interruption.

Referring now to FIG. 8, a second embodiment of the mobile asphalt production machine 10 can be seen. In this second embodiment, the general components will be substantially the same as described above, except as noted below. This second embodiment of the mobile asphalt production machine 10 is particularly adapted to the repair of potholes and is specifically intended to be somewhat smaller than the first embodiment described above since continuous production of bituminous concrete is not a desired aspect of a machine dedicated to the repair of potholes. In fact, small batches of bituminous concrete are the production norm for such a machine, which aspect can be delivered by the instant invention.

The supplemental storage bin 12 at the forward end of the first embodiment of the machine 10 is replaced by a waste storage bin 78 which preferably has hinged doors discharging the waste material from the machine at the end of the day. Waste material would be the loose debris and the debris obtained during the cleanout of the pothole before patching material is delivered thereto. The insulated accumulation chamber 50 at the rear of the first embodiment of the machine 10 is also not needed as large batches of bituminous concrete is not anticipated for use in the repair of potholes. Thus, the insulated accumulation chamber 50 is eliminated, permitting the overall length of the vehicle 10 to be shortened. Furthermore, the sizes of the lateral sand and stone bins 14, 16 do not need to be as large as desired for the first embodiment of the machine 10, thus further reducing the size of the machine.

At the rear of the second embodiment of the machine 10, as shown in FIG. 8, a surge hopper 59 is mounted to receive the discharge of mixed bituminous concrete from the mixing auger mechanism 30 through a discharge chute 75. The surge hopper 59 is mounted in flow communication with a dispensing apparatus 70 that is pivotally mounted for movement through approximately 180 degrees of rotation about a vertical pivot 74. The dispensing apparatus 70 includes a dispensing auger 71 receives bituminous concrete from the surge hopper 59 and conveys the asphalt to a delivery chute 73 through which the material is dropped into the pothole (not shown) to be repaired. The control of the hydraulic motor 72 powering the rotation of the dispensing auger 71 is preferably independent of the master control valve 68 so that material already mixed and received in the surge hopper 59 can be delivered into the pothole for use in the repair thereof without running the mixing auger mechanism 30 and other operative components, although alternatively each of those control valves could be reset at zero to prevent their respective operation while running the dispensing auger 71 from the banded hydraulic system that includes a control valve for operating the dispensing auger 71, according to the principles of the control system described above.

Figure 9:
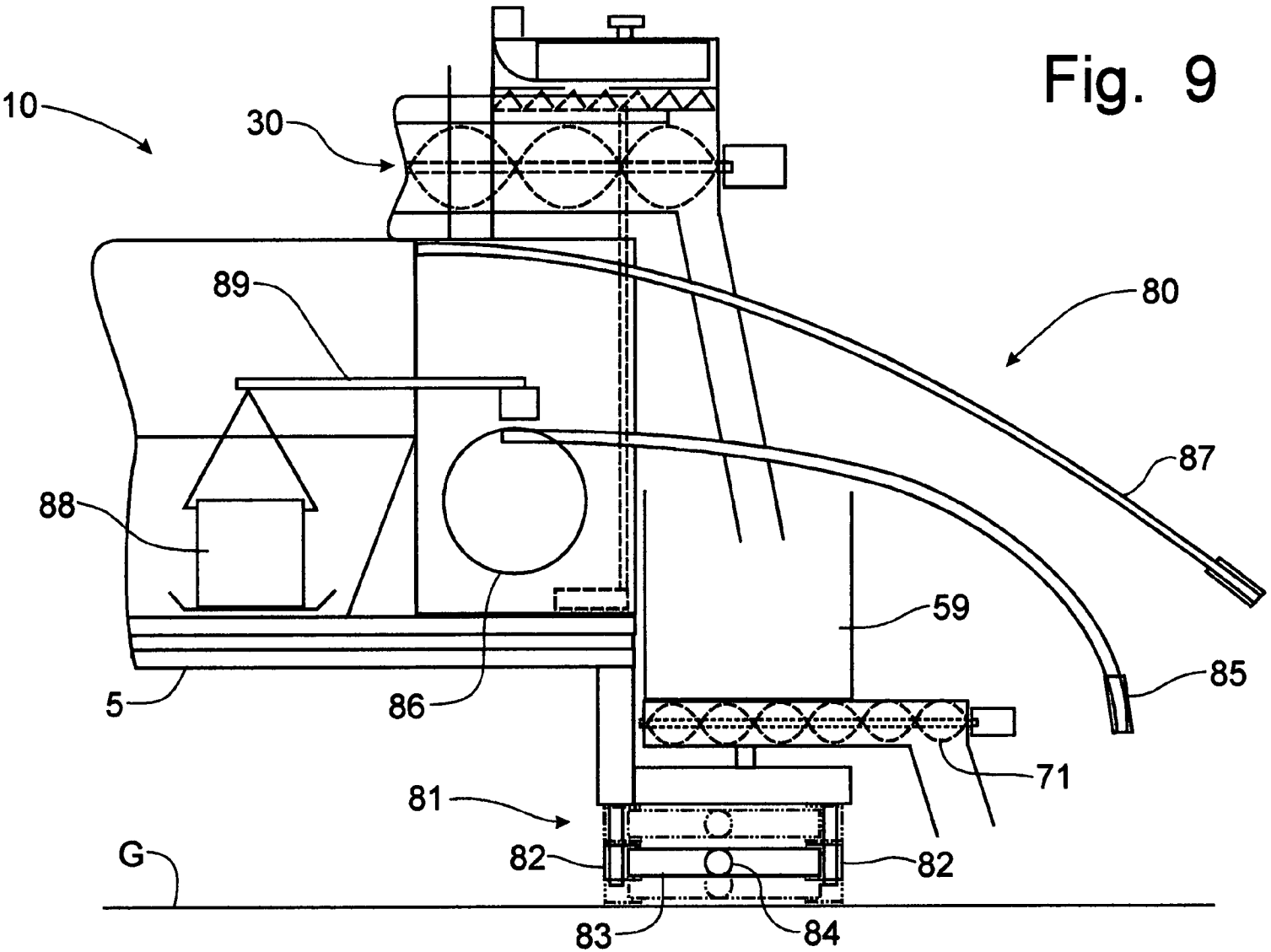
FIG. 9 is a schematic side elevational view of a pothole repair apparatus that can be optionally mounted at the rearward end of the smaller asphalt production machine as depicted in FIG. 8.

This smaller version of the asphalt production machine is ideally adaptable for use as a pothole repair machine. As can be seen in FIG. 9, a pothole repair apparatus can be mounted at the rearward end of the machine 10 to enable an operator to produce a limited supply of hot mix bituminous concrete for use in repairing poleholes, even in the winter time, i.e. times of cold weather. The pothole repair apparatus 80 includes the dispensing auger 71 receiving freshly mixed bituminous concrete from the mixing apparatus 30 through the surge hopper 59. As described above, the dispensing auger 71 is pivotally mounted to be capable of delivering a desired supply of bituminous concrete directly into the pothole.

The pothole repair apparatus 80 includes a heat shield 81 that is supported by frame supports 82 beneath the chassis 5 to be capable of moving vertically from an elevated transport position onto the surface of the ground G, as is indicated in phantom. The heat shield 81 is also preferably formed with a center pan member 83 that is not only positionally adjustable vertically, but also horizontally in a transverse direction so that the heat shield can be accurately placed over top of the pothole to be repaired. The center pan member 83 has mounted thereon a burner 84 that is operable to inject heat energy beneath the center pan member 83 to soften the existing bituminous concrete surrounding the pothole.

After the area around and at the bottom of the pothole has been softened through the application of heat energy, a tack hose 85 can be extended from the reel 86 on which the tack hose 85 is stored to spray liquid bitumen, or other suitable tack material onto the bottom surface of the pothole. The dispensing auger 71 can then be positioned to deliver the required amount of bituminous concrete into the pothole. After tamping suitably, the operator can swing a vibratory compactor 88 from a storage location on the chassis 5 by using a movable support 89, such as a winch, to lower the compactor to the ground G where the bituminous concrete in the pothole can be compacted and properly repaired.

The pothole repair apparatus 80 can also include an air hose 87 that can be used to deliver a stream of compressed air to help clean out the fine debris in the bottom of the pothole before initiating the repair process as described above. The loose debris collected from the cleaning of the pothole to be repaired can be accumulated in a waste storage bin 78 suitably positioned on the chassis 5, as is described above with respect to FIG. 8. Accordingly, the smaller version of the mobile asphalt production machine 10 can be utilized in a manner heretofore unknown. This pothole repair apparatus 80 can be utilized to provide a hot mix pothole repair at times of cold weather when normal asphalt production is not being conducted. As a result, conventional cold weather repairs are made with cold mix asphalt material. A similar process for repairing potholes is shown and described in Applicant's co-pending U.S. patent application Ser. No. 10/944,219, now U.S. Pat. No. 6,988,849, granted on Jan. 24, 2006, the contents thereof being incorporated herein by reference.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

For example, a microprocessor (not shown) could be employed in conjunction with the control system 60 to provide an automated and/or remote control of each hydraulic control valve 61-65, 68. Furthermore, a microprocessor could be programmed with all the different desired recipes for bituminous concrete so that the necessary proportional changes to the control valves 61-65 would be made automatically when the recipe was selected on the microprocessor. A microprocessor can automate other functions on the machine 10, including a monitoring of the temperature within the mixing auger mechanism 30 and adjust the firing of the burners 42, 44 to maintain a desired temperature and to more efficiently utilize energy resources.

Having thus described the invention, what is claimed is:

1. A mobile asphalt production machine comprising:

a mobile frame;

a plurality of storage bins supported on said frame for holding supplies of component materials used in the production of bituminous concrete;

a conveying device associated with each said storage bin to extract respective said component supplies;

a longitudinally extending mixing auger mechanism supported on said frame and positioned to receive said component supplies and to mix said component supplies to produce bituminous concrete, said mixing auger mechanism including an auger having a spiral flighting cooperable with an adjacent auger tube to mix said component supplies and to convey said component supplies rearwardly from a forward inlet end to a rearward discharge end of said mixing auger mechanism;

a burner operable to discharge heat into said mixing auger mechanism at said inlet end between said auger and said auger tube to heat directly said component supplies while being mixed together by said mixing auger mechanism; and a discharge mechanism operable to receive mixed bituminous concrete from said discharge end of said mixing auger mechanism for utilization remotely of said machine.

2. The asphalt production machine of claim 1 wherein said mixing auger mechanism is supported within an insulated housing that forms an annular gap between said housing and said auger tube of said mixing auger mechanism.

3. The asphalt production machine of claim 2 further comprising a second burner associated with said housing to discharge heat into said annular gap.

4. The asphalt production machine of claim 3 wherein said spiral flighting of said mixing auger mechanism is formed as a ribbon flighting supported on a central shaft such that said ribbon flighting is substantially separated from said shaft to permit said component supplies to fall between said ribbon flighting and said central shaft while mixing, said ribbon flighting having a plurality of fins mounted thereon to affect a vertical movement to said component materials being mixed within said mixing auger mechanism.

5. The asphalt production machine of claim 4 further comprising an elevator to collect at least some of said component materials and elevate the collected component materials to said auger tube for introduction into said mixing auger mechanism.

6. The asphalt production machine of claim 5 wherein at least some of said conveying devices are chain and slat conveyors operable at a bottom portion of each respective said storage bin to convey materials therein to said elevator.

7. The asphalt production machine of claim 1 further comprising a control mechanism supported on said frame and operatively connected to each said conveying device and to said mixing auger mechanism to permit an adjustment of the operating speed of each respective device independently of each other said device.

8. The asphalt production machine of claim 7 wherein said control mechanism is a banded hydraulic system including a proportional control for each said conveying device and said mixing auger mechanism arranged in a series with a master control at the beginning of the series so as to be operable to control the rate of operation of all said devices at a proportional rate set for each proportional control.

9. The asphalt production machine of claim 8 wherein each said proportional control has associated therewith a counter to permit calibration of the operation of said proportional control in the delivery of the corresponding said component supply as a function of the operation of the corresponding hydraulic component.

10. A mobile asphalt production machine comprising:

a mobile frame;

a plurality of storage bins supported on said frame for holding supplies of component materials used in the production of bituminous concrete;

a conveying device associated with each said storage bin to extract respective said component supplies;

a longitudinally extending mixing auger mechanism supported on said frame and positioned to receive said component supplies and to mix said component supplies to produce bituminous concrete, said mixing auger mechanism including a ribbon flighting supported on a central shaft such that said ribbon flighting is substantially separated from said shaft to permit said component supplies to fall between said ribbon flighting and said central shaft while mixing, said mixing auger mechanism further including an auger tube mounted for cooperation with said ribbon flighting;

a burner operable to discharge heat into said mixing auger mechanism to heat said component supplies while being mixed together; and a discharge mechanism operable to receive mixed bituminous concrete from said mixing auger mechanism for utilization remotely of said machine.

11. The asphalt production machine of claim 10 wherein said mixing auger mechanism is supported within an insulated housing that forms an annular gap between said housing and said auger tube.

12. The asphalt production machine of claim 11 further comprising a second burner associated with said housing to discharge heat into said annular gap between said housing and said auger tube to heat said component materials indirectly.

13. The asphalt production machine of claim 12 wherein said ribbon flighting is formed with a plurality of fins to affect a vertical movement to said component materials being mixed within said mixing auger mechanism.

14. The asphalt production machine of claim 13 further comprising an elevator to collect at least some of said component materials and elevate the collected component materials to said auger tube for introduction into said mixing auger mechanism.

15. The asphalt production machine of claim 14 wherein at least some of said conveying devices are chain and slat conveyors operable at a bottom portion of each respective said storage bin to convey materials therein to said elevator.

16. A mobile asphalt production machine comprising:

a mobile frame;

a plurality of storage bins supported on said frame for holding supplies of component materials used in the production of bituminous concrete;

a conveying device associated with each said storage bin to extract respective said component supplies;

a mixing auger mechanism supported on said frame and positioned to receive said component supplies and to mix said component supplies to produce bituminous concrete, said mixing auger mechanism including an auger having a spiral flighting supported on a central shaft and being cooperable with an adjacent auger tube to mix said component supplies and to convey said component supplies toward a discharge end of said mixing auger mechanism;

a housing spaced from said auger tube to define an annular gap between said housing and said auger tube;

a first burner operable to discharge heat into said mixing auger mechanism to heat directly said component supplies while being mixed together; and a second burner operable to discharge heat into said annular gap between said housing and said auger tube to heat said component supplies indirectly while being mixed together.

17. The asphalt production machine of claim 16 wherein a discharge mechanism is mounted adjacent said discharge end of said mixing auger mechanism so as to be operable to receive mixed bituminous concrete from said mixing auger mechanism for utilization remotely of said machine.

18. The asphalt production machine of claim 17 wherein said spiral flighting of said mixing auger mechanism is formed as a ribbon flighting supported on a central shaft such that said ribbon flighting is substantially separated from said shaft to permit said component supplies to fall between said ribbon flighting and said central shaft while mixing.

19. The asphalt production machine of claim 18 wherein said ribbon flighting includes a plurality of fins mounted thereon to affect a vertical movement to said component materials being mixed within said mixing auger mechanism.

20. The asphalt production machine of claim 19 further comprising a control mechanism supported on said frame and operatively connected to each said conveying device and to said mixing auger mechanism to permit an adjustment of the operating speed of each respective device independently of each other said device, said control mechanism being a banded hydraulic system including a proportional control for each said conveying device and said mixing auger mechanism arranged in a series with a master control at the beginning of the series so as to be operable to control the rate of operation of all said devices at a proportional rate set for each proportional control.

* * * * *